United States Patent [19]

Shriver et al.

[11] Patent Number: 4,606,942

[45] Date of Patent: Aug. 19, 1986

[54] SPRAY COATING APPARATUS

[75] Inventors: Frank L. Shriver, Lakewood; Roger A. Hahn, Arvada, both of Colo.

[73] Assignee: Adolph Coors Company, Golden, Colo.

[21] Appl. No.: 685,022

[22] Filed: Dec. 21, 1984

[51] Int. Cl.[4] ..... B05B 13/06; B05D 1/02

[52] U.S. Cl. ..... 427/233; 427/236; 118/317; 118/318; 118/321; 118/DIG. 10

[58] Field of Search ..... 427/233, 236; 118/320, 118/321, 317, 318, DIG. 10

[56] References Cited

U.S. PATENT DOCUMENTS

| | | | |
|---|---|---|---|
| 745,729 | 12/1903 | Kiser | 417/568 |
| 932,609 | 8/1909 | Hodgson | 118/318 X |
| 1,278,853 | 9/1918 | Caverno | 417/568 |
| 2,103,270 | 12/1937 | Murch | 118/318 X |
| 2,254,495 | 9/1941 | Randolph et al. | 417/413 |
| 2,285,370 | 6/1942 | Staelin | 427/233 X |
| 2,562,871 | 7/1951 | Palermo | 118/DIG. 10 |
| 3,007,810 | 11/1971 | Hobrock | 118/318 |
| 3,250,225 | 5/1966 | Taplin | 417/413 |
| 3,410,250 | 11/1968 | Kulie et al. | 118/317 |

FOREIGN PATENT DOCUMENTS

| | | | |
|---|---|---|---|
| 845052 | 10/1939 | France | 118/318 |
| 917627 | 2/1963 | United Kingdom | 118/318 |

*Primary Examiner*—Shrive P. Beck

*Attorney, Agent, or Firm*—Klaas & Law; Bruce G. Klass; William P. O'Meara

[57] ABSTRACT

Method and apparatus for spray coating the interior cavity of a plastic bottle with a barrier material. The apparatus includes a spraying assembly for moving a nozzle body into and out of the interior cavity of the bottle while the bottle rotates about its central longitudinal axis. A spraying control system causes a predetermined amount of coating material to be dispensed to selected regions of the bottle as a function of the nozzle body linear displacement relative the bottle.

10 Claims, 18 Drawing Figures

SPRAY COATING APPARATUS

BACKGROUND AND SUMMARY OF THE INVENTION

The present invention relates generally to plastic bottle formation and, more particularly, to a spray coating apparatus for applying first a primer coat and then a top coat of liquid coating material to the interior surface of a plastic bottle to provide a barrier layer between the contents of the bottle and the plastic material used to form the bottle and to limit diffusion of gases through the walls of the bottle.

Containers constructed from thermoplastic material have become widely used in the beverage industry, competing with traditional metal and glass containers. Attractive features of plastic containers include high resistance to rupture, transparency and light weight. A drawback of thermoplastic beverage bottles has been the relatively high cost of the plastic materials which are presently used to produce such bottles. Polystyrene, which costs significantly less than most plastics presently used to form bottles, is readily available as a by-product from the formation of more expensive plastic materials. However, there are presently no polystyrene containers in commercial use as containers for pressurized beverages because of a number of production related problems. Polystyrene bottles to be economically feasible must be capable of being produced rapidly and, as a finished product must be able to contain carbonated beverages under pressure without significant loss of carbonation from the beverage or without diffusion of oxygen from the atmosphere into the beverage. The molecular structure of polystyrene is such that for wall thicknesses that are sufficiently thin to be economically feasible, a coating layer of another material must be applied over the inner surface of the bottle to limit gas diffusion to acceptable levels.

Additionally, it has been found that a coating layer of chemically inert material is necessary to isolate the bottle contents from physical contact with the polystyrene to prevent chemical reaction therewith and deterioration of the taste of the bottled beverage. The most efficient manner presently known by applicant to provide a barrier between the bottled contents and the polystyrene material forming the bottle is to apply first a coating layer of latex primer material and, after the primer layer has dried, to apply a top coat layer of polyvinylidene chloride latex (PVDC latex).

To be economically feasible, it is necessary to apply the coating layers to plastic bottles at relatively high speeds, but in a manner that ensures complete coating of the bottle interior surface and which ensures that the coating layers are within predetermined thickness tolerences. If the coating layers are too thick, then drying time and thus bottle production time, is increased driving up production costs. On the other hand, if the coating layers are too thin or incomplete the intended barrier properties of the coating layers are not realized.

A significant problem in applying precise and even thickness coating layers is caused by the relatively restricted opening and the varying diameter of the interior cavity of most bottles. A further problem with coating application may result from the physical characteristics of the coating medium. The coating materials may be applied as liquid emulsions which are nonnewtonian fluids. Such liquids are not easily dispensed in uniform spray patterns over distances of more than a few centimeters.

The present invention comprises an apparatus capable of applying a precise, uniform coating layer to the interior surface of a bottle having a relatively restricted opening into its interior cavity. The apparatus is adapted to be operational at relatively high speeds even when the coating material being dispensed is a nonnewtonian fluid.

DETAILED DESCRIPTION OF THE INVENTION

Figure 1:
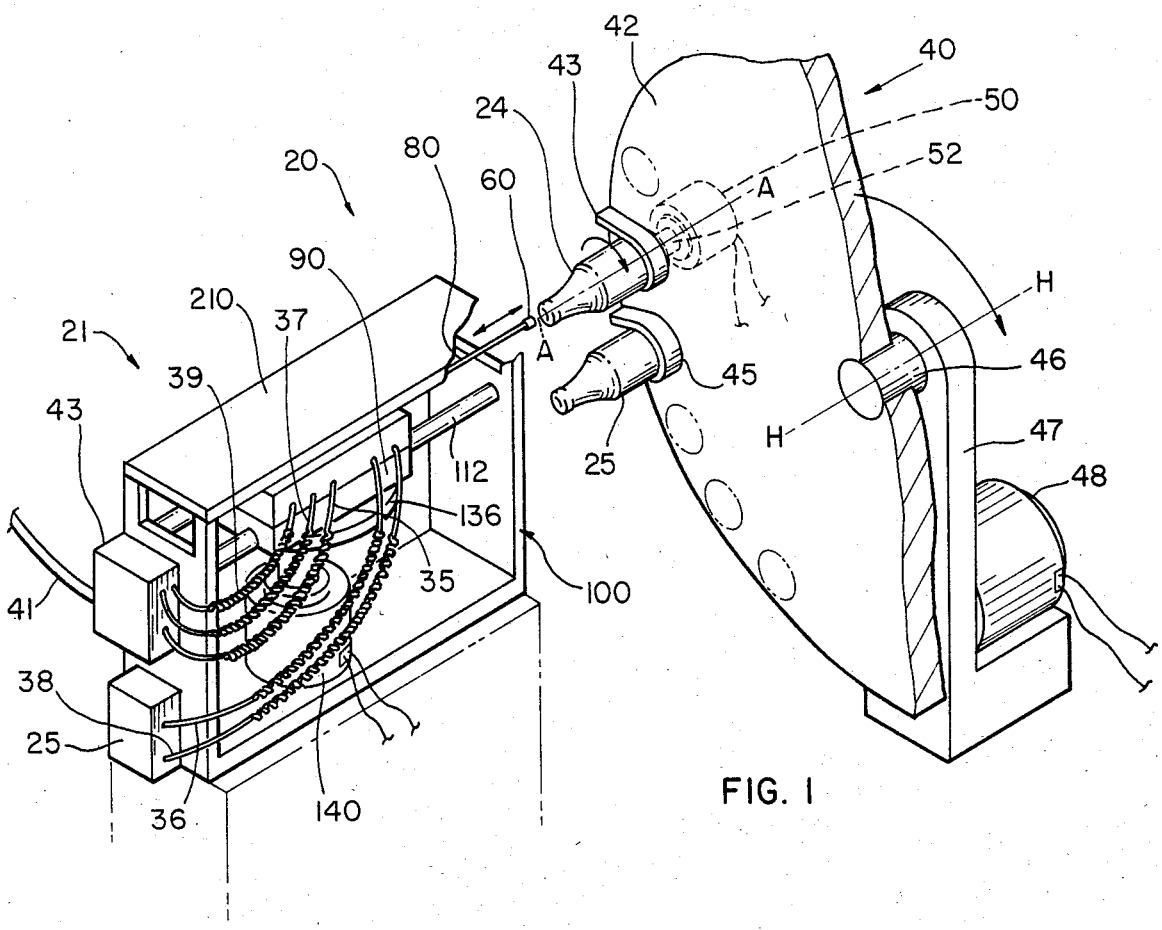
FIG. 1 is a simplified, partially broken-away perspective view of a spray coating apparatus for coating the interior surface of a bottle.

The present invention comprises a spray coating apparatus 20 for coating the interior surface of a bottle 24, or other similar vessel, having a relatively restricted opening 34 and an elongated interior cavity 19. In the embodiment of the invention illustrated in FIG. 1, the spray coating apparatus comprises a spraying assembly 21 which dispenses a liquid coating material to the interior of the bottle 24, and a pocket wheel 40 which aligns a bottle to be sprayed with the spraying assembly 21 and which rotates the bottle 24 about its central axis AA as its interior is sprayed by the spraying assembly 21.

The pocket wheel, as illustrated in simplified schematic form in FIG. 1, consists of a circular disc 42 having a series of equally spaced circumferential pockets 43, 45 (only 2 shown positioned around the entire periphery of the disc 42). The pockets 43, 45 hold the bottles 24, 25 at fixed circumferential and radial positions o the pocket wheel. The pockets 43, 45 are adapted to receive bottles from an infeed means and are also adapted to discharge the bottles to further processing equipment after spray coating thereof and after movement of the disc 42 through a predetermined circumferential arc. The pocket wheel disc 42 may be fixedly mounted on a shaft 46 which is in turn journaled to a suitable support structure 47. The pocket wheel disc 40 is rotated by suitable drive means such as electric motor 48 and associated linkage (not shown). In operation, the pocket wheel 40 is rotationally stationary during coating of each bottle.

Subsequent to the completion of a coating operation, the pocket wheel disc is rotated through a small circumferential arc until the bottle 25 in the next succeeding pocket 45 is aligned with the spraying assembly 21 for subsequent coating. After the pocket wheel is stopped, a bottle to be spray coated is engaged by a bottle rotation means such as bottle rotation motor 50 and associated linkage 52, which are positioned in fixed relationship with respect to the spraying assembly 21 (i.e. the bottle rotation means does not rotate with the pocket wheel disc 42). Conventional means for accomplishing bottle engagement include the use of axially extendable and retractable suction cup devices which selectively engage the bottle bottom and other similar devices which are well known in the art. The interior of the bottle is spray coated by spray dispensed from a nozzle means such as nozzle body 60. The nozzle means is extended into and retracted from the bottle 24 as the bottle is rotated by the bottle rotation means. Apparatus for circumferential movement of a container (e.g. about axis HH) and for rotation of a container (e.g. about axis AA), as described above, are conventional and well known in the art and are sometimes referred to in the industry as "star wheels".

Typical examples of star wheels which might be used in combination with the spray assembly 21 of the present invention include: Crown Model 6PA Sprayer produced by Crown Cork and Seal Company, Inc., 9300 Ashton Road, Philadelphia, Pa., 19136; Belvac Model CS22 Can Spray Machine, Belvac Production Machinery, Box 4276, Lynchburg, Va., 24502; and Model 102M5H Internal Spray Machine, H. L. Fisher Manufacturing Company, Inc., 1225 Forest Avenue, Des Plaines, Ill., 60018.

Figure 4:
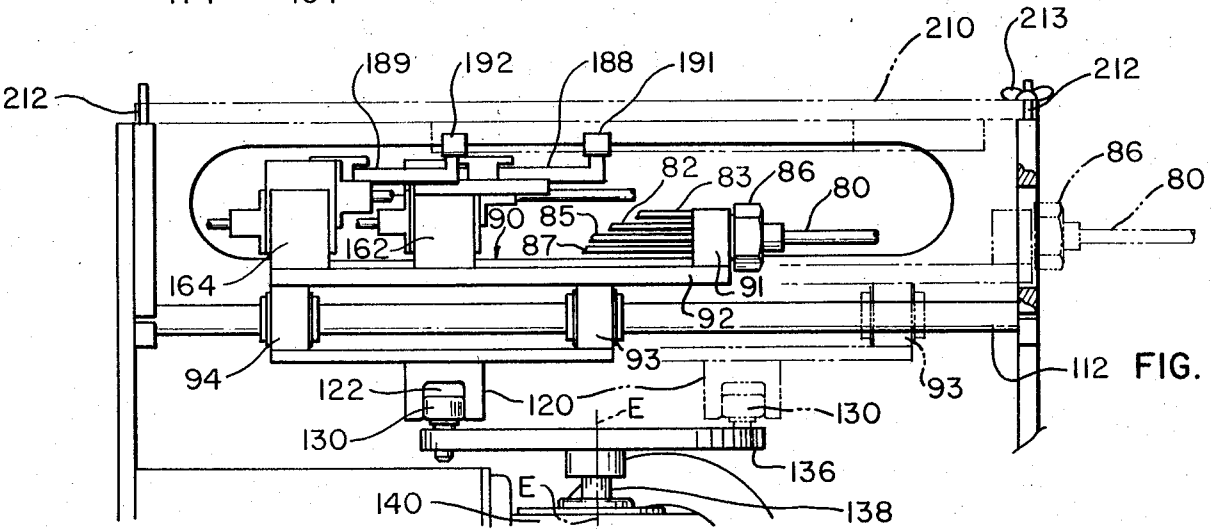
FIG. 4 is a partially cut-away, side elevation view of the spraying assembly of FIGS. 2 and 3 with a moved position of a sliding bed assembly shown in phantom.
Figure 5:
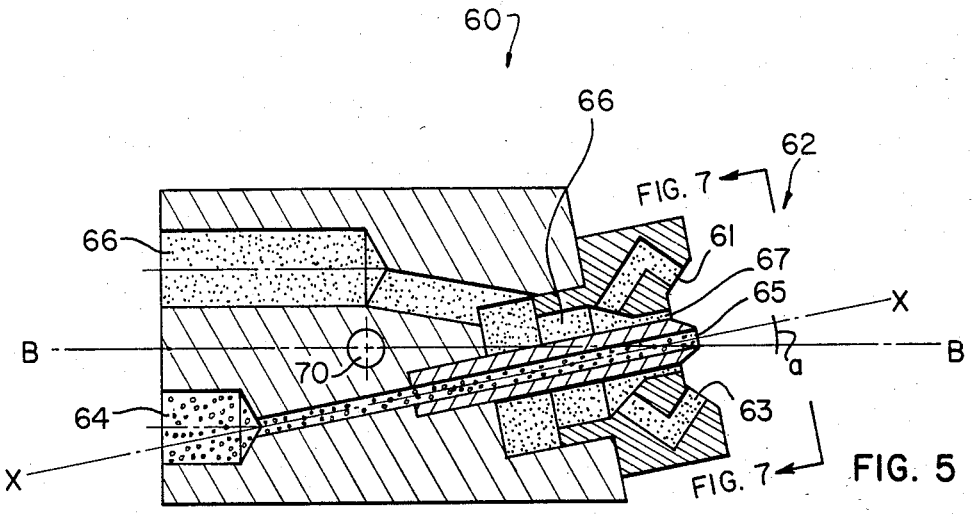
FIG. 5 is a cross-sectional view of a terminal end portion of a spray nozzle body.
Figure 6:
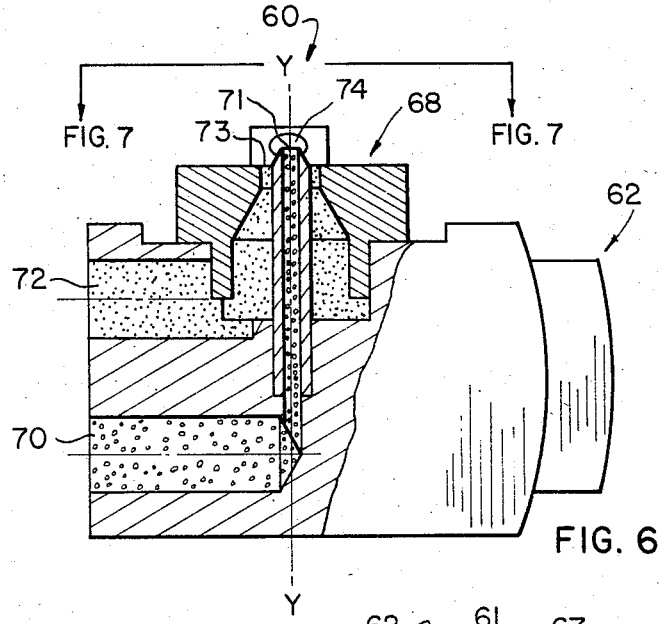
FIG. 6 is a partially cross-sectional, side elevation view of the nozzle body of FIG. 5 in a ninety degree rotated position from the view of FIG. 5.
Figure 7:
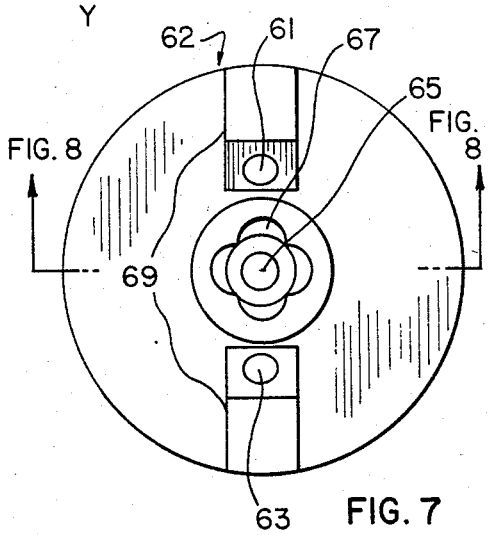
FIG. 7 is an elevation view taken perpendicular to the side nozzle illustrated in FIG. 6.

The spraying assembly 21 of the present invention may include, in general, a nozzle means for sprayingly dispensing a coating material to the interior surface of a bottle 24 to be coated which may include a multiple nozzle tip arrangement such as nozzle body 60, FIGS. 5–7. The nozzle body 60 is mounted on a elongate lance means such as tubular lance 80, which may carry one or more coating material lines 81, 83, 85, FIG. 2, and one or more pressurized air lines 87, 89 which communicate with nozzle body 60. The lance means 80 may be fixedly supported on a sliding bed assembly 90 which is in turn slidingly mounted for reciprocal movement on guide rail means such as guide rail members 110, 112. Reciprocal movement of the sliding bed assembly 90, which causes the nozzle means to be inserted and retracted from an oppositely positioned bottle 24, is produced by a longitudinal displacement means such as electric motor 140, rotating disc 136 and an associated cam follower 130 which is in turn received within a cam track 122 affixed to the bottom of the sliding bed assembly 90. Liquid coating material, under pressure, is provided by a coating material supply line 41. In the presently preferred embodiment of the invention, the coating material from the supply line passes through a conventional three-way splitter valve 43 and is thereafter supplied through a plurality of flexible pump supply lines 35, 37, 39 to a pump means which may include a plurality of pumps 160, 162, 164, FIG. 2, which are fixedly mounted on the sliding bed assembly 90. A source of atomizing air may be provided as by air compressor 25 which provides air to the nozzle means through flexible air supply lines 36, 38, 87, 89, FIGS. 1 and 2. As illustrated in FIGS. 5–7, the nozzle body 60 may comprise a tip nozzle 62, with a central longitudinal axis XX, oriented at a slight angle with respect to the longitudinal axis BB of the nozzle body 60, and a side nozzle 68, with a central longitudinal axis YY, oriented perpendicular to the longitudinal axis of the nozzle body 60. During coating of the interior surface of a bottle 24, the tip and side nozzle are actuated at different times to coat different surface portions of the bottle. In one typical bottle configuration, the bottle interior surface 22 comprises a bottom wall surface 26, a lateral side wall surface 28, a shoulder wall surface 30, and a neck wall surface 32. As illustrated in FIGS. 11–18, the tip nozzle and side nozzle are actuated at different times during the movement of the nozzle body 60 into and out of the bottle. The different spraying cycles are accommodated by pump means comprising a plurality of pumps 160, 162, 164, FIGS. 2–4, which are fixedly attached to the sliding bed assembly 90 for movement with the lance means and nozzle means. The pump means are actuated at predetermined nozzle orientations with respect to the interior of the bottle 24 by pump control means including an upper cam assembly 210, having three separate cam paths 216, 218, 220, which causes coating material to be dispensed from the pumps as a function of the longitudinal position of the sliding bed assembly 90.

Having thus described the invention in general, the spray coating assembly 21 of the spray coating apparatus 20, will now be described in further detail.

Nozzle Means

As best shown in FIGS. 5–7, the nozzle means of the present invention may comprise an elongate nozzle body 60, having a central longitudinal axis BB. A tip nozzle 62 is provided at the terminal end of the nozzle body 60. The tip nozzle longitudinal axis XX is positioned in slightly skewed relationship with respect to the nozzle body longitudinal axis BB. The amount of angular deflection between axis BB and XX, angle "a", is generally between 0 degrees and 30 degrees and is preferably about 15 degrees. Tip nozzle 62 is in fluid communication with a tip nozzle liquid passage 64, which terminates at tip nozzle orifice 65.

In one embodiment of the invention, the orifice diameter is substantially 0.030 inches and accommodates a maximum liquid flow rate of approximately 0.03 gallons per minute. The tip nozzle 62 also comprises a tip nozzle air passage 66 terminating in a tip nozzle atomizing air orifice 67, having a clover shaped configuration positioned around the periphery of liquid passage orifice 65, as best shown in FIG. 7. The tip nozzle may also comprise first and second shaping air orifices 61, 63 connected in fluid communication with tip nozzle air passage 66.

As best shown in FIG. 6, the nozzle body 60 also comprises a side nozzle 68 having a central longitudinal axis YY positioned substantially perpendicular to nozzle body axis BB. As with the above described tip nozzle 62, the side nozzle 68 comprises a side nozzle liquid passage 70 terminating in a liquid passage orifice 71, which may be of substantially the same size as that of the tip nozzle. Side nozzle 68 also comprises an air passage 72 terminating, at one branch, in an atomizing air passage orifice 73 positioned in a clover shaped configuration about fluid orifice 72. In addition, the side nozzle may comprise a first and second shaping air orifices 74 (only one shown) connected in fluid communication with the side nozzle air passage 72 in an identical configuration as described above for the tip nozzle 62. The first and second shaping air orifices of each nozzle are positioned in diametrically opposed relationship with respect to the center of the associated fluid orifice 65 or 71. Orifice 61 and orifice 63 may be positioned approximately 0.125 inches apart and may comprise a diameter of substantially 0.030 inches. The air provided to the various air passage orifices 61, 63, 67, 73, 74, 76 may be under a pressure of between 20 psig and 60 psig and preferably substantially 30 psig. The flow rate of air from orifice 67 and 73 may be approximately 0.7 SCFM each, and from shaping air orifices 61, 63, 74 etc., may be approximately 0.6 SCFM each. The air supply to each nozzle may be provided by a separate air line 87, 89 allowing independent control of each nozzle air pressure.

Lance Means

Figure 2:
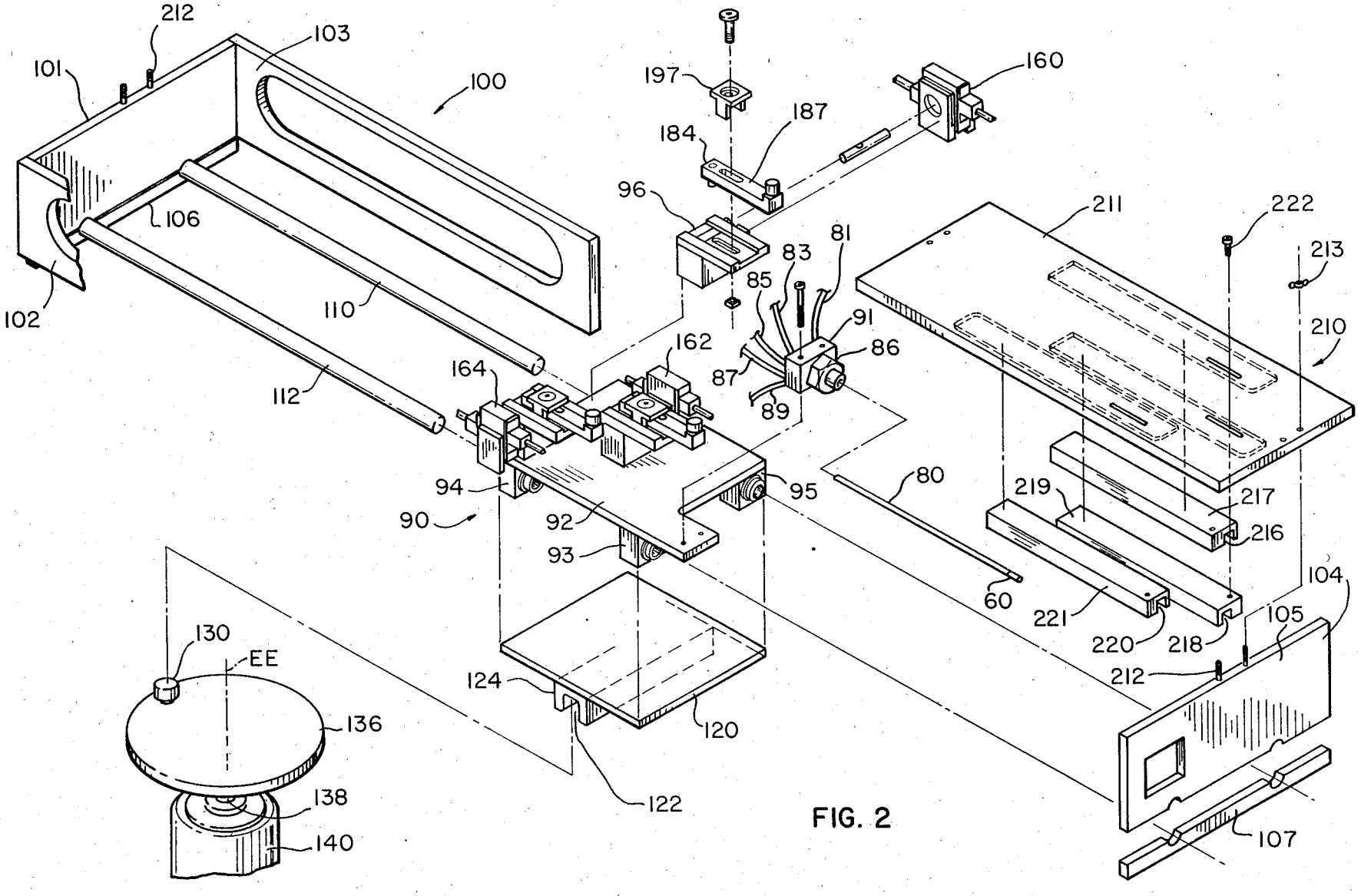
FIG. 2 is an exploded perspective view of a spraying assembly of the spray coating apparatus of FIG. 1.
Figure 3:
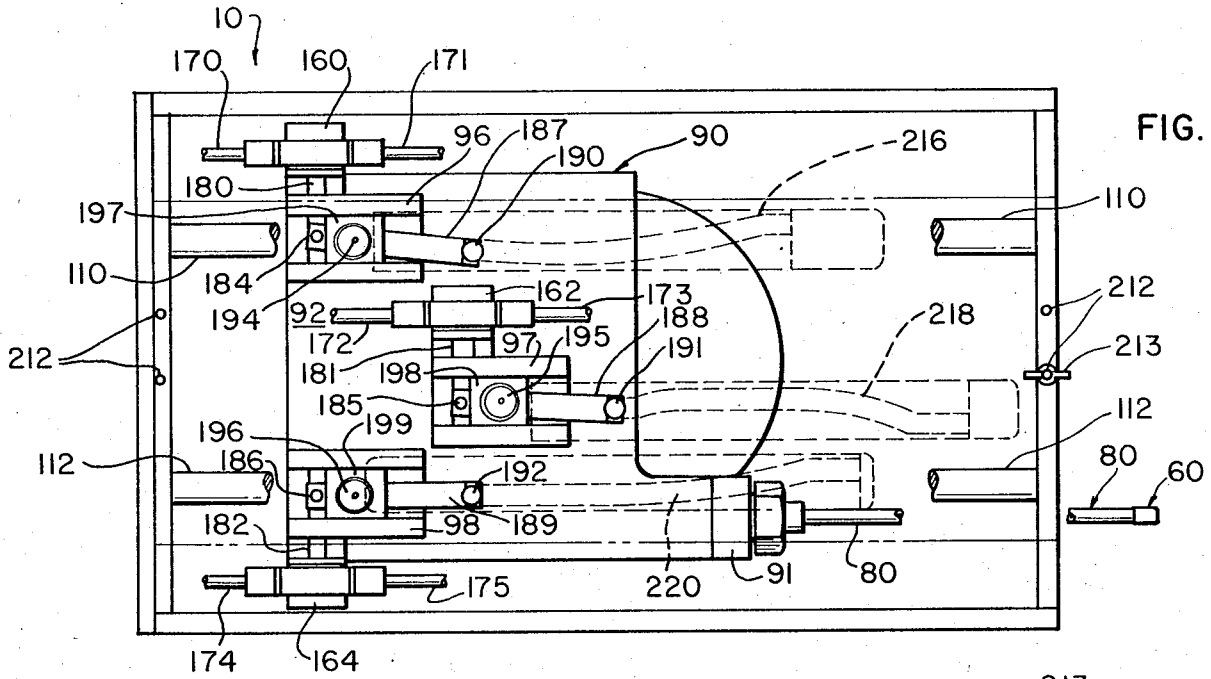
FIG. 3 is a partially cut-away, top view of the spraying assembly of FIG. 2, with an upper cam plate assembly thereof removed, but with cam path portions of the cam assembly shown in phantom.

As illustrated in FIGS. 2, 3 and 4, the lance means may comprise an elongate tubular lance 80, adapted to receive the nozzle means 60 at a terminal end portion thereof by conventional attachment means such as i.e., threading or adhesive attachment or alternately the lance 80 may be integrally formed with the nozzle body 60.

The lance 80 may be attached as by a conventional coupling means 86 to an attachment block portion 91 of sliding bed assembly 90, described in further detail below. The tubular lance 80 is adapted to receive a plurality of smaller conduit portions, which in the presently preferred embodiment, comprise fluid lines 81, 83, 85 for a first pump, second and third pump 160, 162, 164 respectively, and two air lines 87,89. As mentioned above, independent air lines 87, 89 communicate with the air passages 66, 72, respectively, of nozzle tips 62, 68. The first pump line 81 and the third pump line 85 communicate with the side nozzle fluid passage 70 and the second pump line 83 communicates with the tip nozzle fluid passage 64.

Longitudinal Displacement Means

It may be seen, reference to FIGS. 2, 3 and 4, that the lance means nozzle means of the present invention are moved into and out of an oppositely positioned bottle by a longitudinal displacement means which, in the illustrated embodiment comprises a sliding bed means, a guide rail means, a sliding bed cam means, and a motor means.

As best illustrated in FIG. 2, the sliding bed means comprises a sliding bed assembly 90 which may include a planar slide plate 92, having four guide sleeves (only three shown) 93, 94, 95 fixedly mounted as by bolting or the like to the lower surface thereof and constructed and arranged to slidingly receive parallel guide rails 110, 112 therein, as described in further detail hereinafter. The slide plate 92 may have a number of mounting blocks, etc. affixed to the upper surface thereof to facilitate mounting of three pump assemblies, as described in further detail hereinafter. A fixed assembly 100 is provided for slidingly supporting the slide bed assembly 90. The fixed assembly 100 may comprise a generally rectangular configuration having a rear wall 101, a pair of lateral side walls 102, 103 and a forward wall 105. The rear wall and forward wall may, in turn, comprise clamp portions 106, 107, respectively, for clampingly receiving guide rail means such as guide rail members 110, 112 in parallel relationship therewithin. As mentioned above, the guide rail numbers 110, 112 are slidingly received within the four guide sleeves 93, 94, 95, etc. and thus, limit movement of the sliding bed assembly 90 to a reciprocal movement in a longitudinal. The longitudinal path defined by the guide rail mean is parallel to the longitudinal axis BB of the nozzle body 60 and lance 80. Thus, the lance means and nozzle means, which are attached to the sliding bed means as by block assembly 91, are reciprocally movable in a longitudinal direction through longitudinal movement of the sliding bed means.

In one embodiment, reciprocal movement of the sliding bed means is produced by a sliding bed cam assembly including a lower cam plate 120 fixedly mounted on the lower surface of the four sliding bed guide sleeves, as by bolted attachment or other well known attachment means. A transversely extending lower cam track 122 is provided at a central position on the cam plate 120 by a transversely extending u-shaped member 124. A cam follower 130 is received within the lower cam track 122. The cam follower 130 is, in turn, rotatably mounted on a rotating disc 136, which is, in turn, mounted on a centrally positioned rotating shaft 138 (having an axis EE positioned perpendicular nozzle axis BB) of a motor means such as electric motor 140. As best shown in FIG. 4, orbital movement of the cam follower 130 about the central axis BB of rotating shaft 138, causes reciprocal movement of the sliding bed assembly between a rearward most position, as illustrated in solid lines in FIG. 4, and a forward most position, as illustrated in phantom lines in FIG. 4.

Pump Means

As best shown by FIGS. 2, 3 and 4, pump means are provided for delivering predetermined amounts of liquid coating material to the nozzle means at predetermined portions of the reciprocal movement cycle of the nozzle means. In the presently preferred embodiment, the pump means comprise a first pump 160, a second pump 162 and a third pump 164. The first and third pumps 160, 164 are associated with the side nozzle 68 and the second pump means 162 is associated with the tip nozzle 62. Each of the three pumps 160, 162, 164 has associated therewith an inlet conduit 170, 172, 174, respectively, and an outlet conduit 171, 173, 175, respectively, the inlet conduits being associated with the inlet supply lines 35, 37, 39, as discussed above with respect to FIG. 1, and the outlet conduits being associated with the nozzle supply lines 81, 83, 85, discussed above with respect to the lance means, and reference to FIG. 2. Each pump has associated therewith a pump piston 180, 181, 182, respectively. Each piston is pivotally attached at 184, 185, 186, to a piston lever arm 187, 188, 189, respectively. The end of each piston lever arm opposite the point of pivotal connection with the pump piston has mounted thereon a cam follower 190, 191, 192, respectively. Each piston lever arm 187, 188, 189 is pivotally mounted about a lever piston axis 194, 195, 196, respectively. A slidable plate 197, 198, 199, respectively, which cooperates with a slotted mounting block 96, 97, 98, respectiveiy, and a slotted portion within each lever 187, 188, 189, respectively, is provided to adjust the associated piston stroke length, etc.

Figure 9:
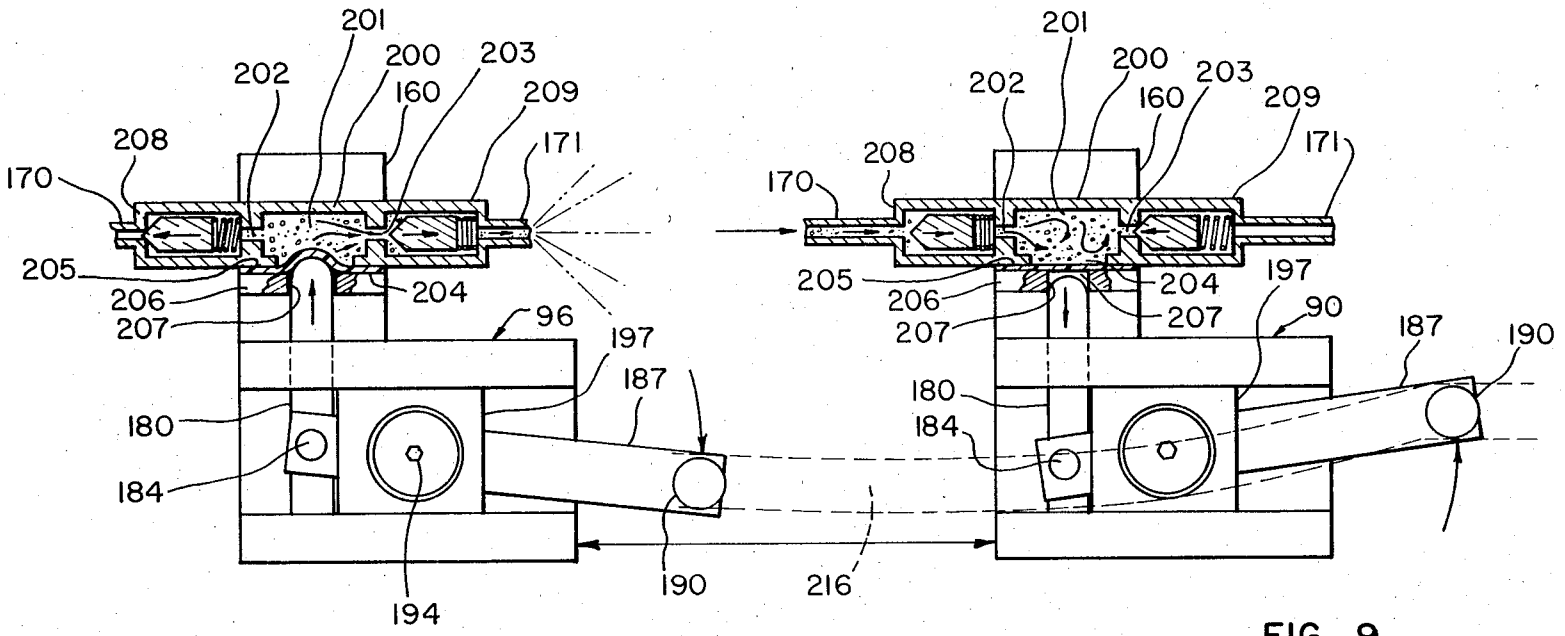
FIG. 9 is a detail schematic view illustrating two operating positions of a fluid pump and associated cam assembly used on the spraying assembly of FIGS. 2–4.
Figure 8:
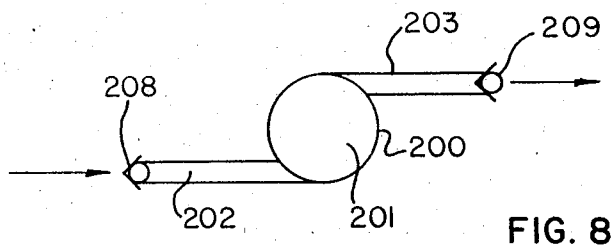
FIG. 8 is a schematic cross-sectional view illustrating the relative elevations of the inlet and outlet orifices of a fluid pump used on the spraying assembly of FIGS. 2–4.

As best shown in FIG. 9, each piston pump (exemplified by pump 160) comprises a pump body 200 having a pump body cavity 201. Each pump body cavity, in turn, communicates with an inlet orifice 202, an outlet orifice 203, and a piston port 204. As best shown in FIG. 8, the onlet orifice 203 is preferably positioned at an upper most elevation with respect to the pump body cavity 201 for the purpose of allowing any gas bubbles which may enter the cavity to migrate to the outlet orifice for immediate discharge. If gas were to build up in the pump body cavity without being removed, a "hydraulic spring effect" produced by the gas would interfere with the valve operation and fluid metering of the system. In one preferred embodiment, the piston port 204 may be covered with a resilient diaphram 205 held in position by a seal plate 206 having a seal plate bore 207 therewithin adapted to allow passage of an associated piston 180 therethrough. The diaphram is deformable by the associated piston and acts as a seal. Each pump cavity inlet orifice communicates directly with a first one-way valve such as conventional spring biased one-way valve 208. Each outlet orifice communicates directly with a second one-way valve such as spring biased one-way valve 209. The biasing force on the first one-way valve is less than the biasing force on the second one-way valve, e.g. 2 psi and 10 psi respectively, and thus, insertion of a piston into a pump body cavity causes outflow of liquid coating material from the cavity through the second one-way valve, and withdrawal of the piston from the pump cavity causes the outlet one-way valve to close and causes the inlet one-way valve to open, allowing recharging of the pump cavity from the supply line. It will be appreciated that in such an arrangement, the amount of coating material dispensed to the nozzle means from any particular pump, is directly proportional to the amount of linear extension of the associated piston into the pump cavity. In another embodiment of the pump assemblies, the diaphram 205 may be eliminated and a tight sliding seal is provided directly between the outer surface of the piston and the piston port of the pump body. However, the diaphram arrangement is presently preferred as a less expensive and more maintenance free configuration.

Pump Control Means

The amount of coating material dispensed from the pump means to the nozzle means is precisely controlled by a pump control means enabling the thickness of the coating layer applied to the interior of a bottle 24 to be precisely controlled. In the presently preferred embodiment, the pump control means comprises an upper cam assembly 210 including an upper cam plate 211 which is fixedly attached to fixed assembly 100 as by attachment bolts 212, and nuts 213, as illustrated in FIG. 2. A first, second and third cam path 216, 218, 220 which receive cam followers 190, 191, 192, respectively, are provided by first, second and third elongate cam members 217, 219, 221, respectively, which may be fixedly attached to cam plate 211 as by attachment bolts 222. The cam paths 216, 218, 220 are shown in superimposed form in FIG. 3, and are shown in further detail in FIG. 18.

Operation

Figure 10:
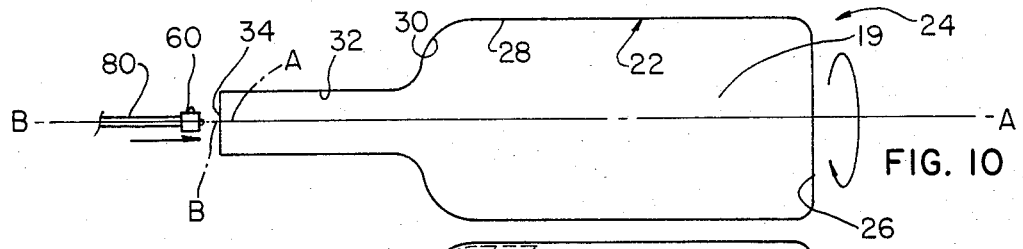
FIGS. 10–17 are schematic, cross-sectional illustrations showing the spraying sequence of the spraying assembly of FIGS. 1–4.
Figure 18:
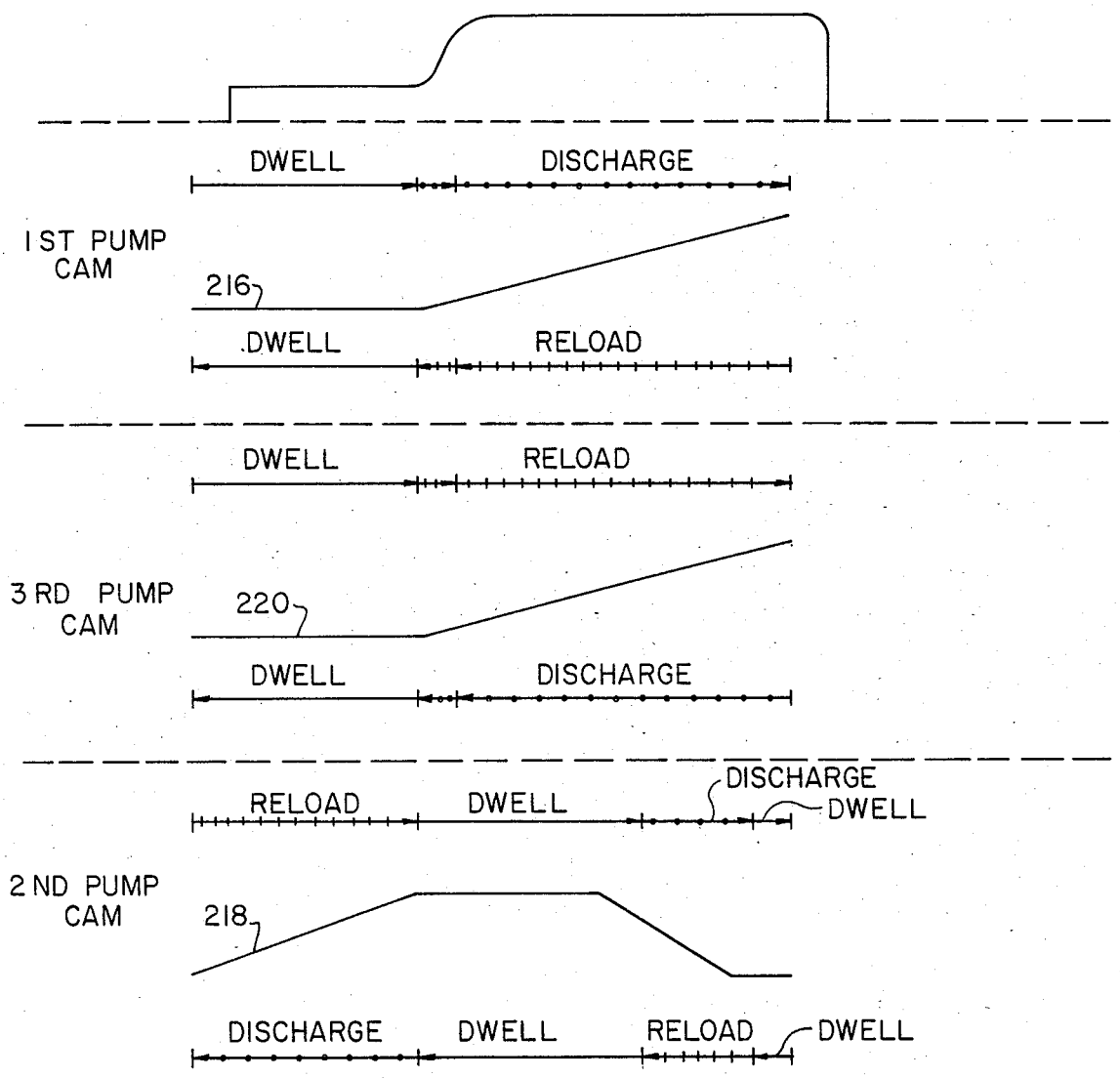
FIG. 18 is an exaggerated schematic drawing of the pump cam paths showing the relationship between the cam paths and a bottle to be sprayed.

The operation of the invention will now be described with reference to FIGS. 10–18. A bottle 24 having a central longitudinal axis AA is initially positioned in coaxial alignment with the central longitudinal axis BB of nozzle and lance assembly 60, 80. The nozzle body 60, as illustrated in FIG. 10, is initially positioned in close proximity, i.e. one inch, from the opening 34 in the bottle 24. The position of the slide bed assembly 90, for the nozzle position illustrated in FIG. 10, is shown in solid lines in FIG. 4 (i.e. the slide bed assembly 90 is at its rear most orientation). During a complete operating cycle, the electric motor 140 will rotate the lower cam 130 through a complete 360 degree revolution about axis EE during which time the nozzle means will move first forwardly from the position illustrated in FIG. 10, to the position illustrated in FIG. 13 and thereafter, will move rearwardly from the position illustrated in FIG. 13 to the position illustrated in FIG. 17. During this forward and rearward movement of the nozzle 60, the bottle 24 is rotated about its central axis AA by bottle rotation means 50, 52 at a constant angular velocity, preferably between 1200 rpm and 2400 rpm, and, most preferably, about 1800 rpm. It may be seen from FIGS. 10–18 that the nozzle means is initially moved inwardly from the position illustrated in FIG. 10, to a position just prior to reaching that shown in FIG. 11, without spraying from either nozzle tip. At the position illustrated in FIG. 11, the side nozzle initiates spraying of the bottle shoulder portion 30. The spraying is caused by insertion of piston 180 into the interior cavity of first pump 160, which is in turn caused by the lateral deflection of cam follower 190, as best shown in FIG. 18. The first pump continues to be actuated by inward movement of its piston until the nozzle body 60 reaches the position illustrated in FIG. 13. It will be appreciated that revolution of the bottle during longitudinal movement of the nozzle means therewithin, causes a spiral pattern to be sprayed onto the interior shoulder wall and lateral side wall 30, 28. The included angle of the spray pattern at the nozzle tip is preferably sufficient to cause a substantial overlapping, e.g. a 15% overlapping of the forward and rear portions of the spiral path being sprayed. In a typical operation, the rate of longitudinal movement of the nozzle lance assembly may vary from 0 to 33.5 inches per second in a sinusoidal speed profile with a total cycle time of 0.75 seconds. As further illustrated by FIG. 18, during the movement of the nozzle body in a rearward direction from FIG. 13 to FIG. 17, the first pump stops discharging and is reloaded in the interval between FIGS. 13 and 15 by withdrawal of the associated piston and inflow of coating material from the supply means 41 and associated supply line 35, through the one-way valve 208 associated with the pump body inlet orifice 202. In a preferred embodiment, a liquid coating material having a viscosity of approximately 150 centipoise is provided through line 35 having an internal diameter of about 0.17 inches, at a pressure of approximately 3 psig. The one-way valve 208 is adapted to be actuated at a pressure differential of approximately 2 psi. The one-way valve 209, at the pump outlet 203, is adapted to be actuated at a pressure differential of approximately 10 psi. As shown by FIG. 18, during the movement of the nozzle means between the position shown in FIG. 10 and FIG. 11, the third pump cam is in a dwell position, and from the position illustrated in FIG. 11 to the position illustrated in FIG. 13, the third pump is caused to reload by withdrawal of its associated piston in the same manner as described above with respect to the first pump. From the position illustrated in FIG. 13 to the position illustrated in FIG. 15, the third pump is caused to discharge by insertion of its piston into its cavity causing a second spiral pattern to be provided. The second spiral pattern is opposite in direction to that of th first spiral pattern, but may be of identical overlap and thickness. The total coating thickness of both spiral spray patterns, when completed, is preferably, about 0.0008 inches wet thickness which dries to a thickness of about 0.0003 inches. During movement of the nozzle body from the shoulder position illustrated in FIG. 15, to the out of bottle position illustrated in FIG. 17, the third pump stops spraying due to the fact that its cam is positioned in a dwell orientation.

Figure 11:
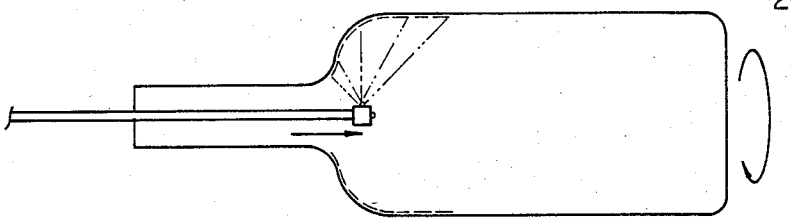
Figure 12:
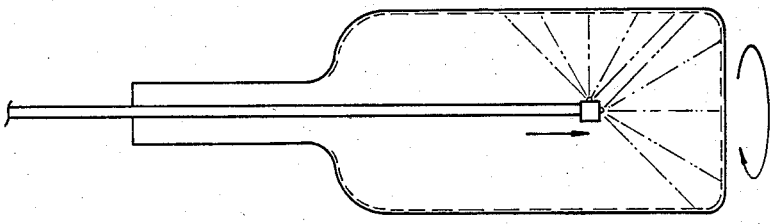
Figure 13:
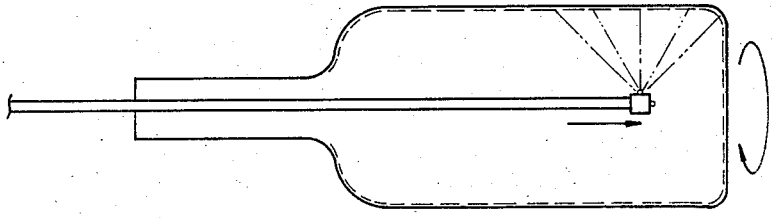
Figure 14:
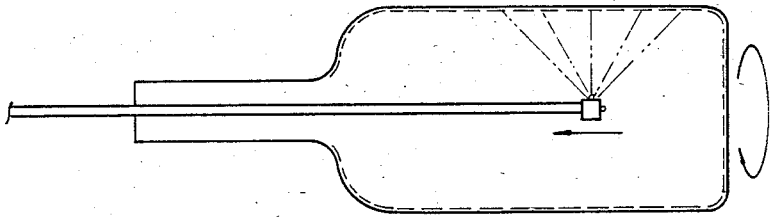
Figure 15:
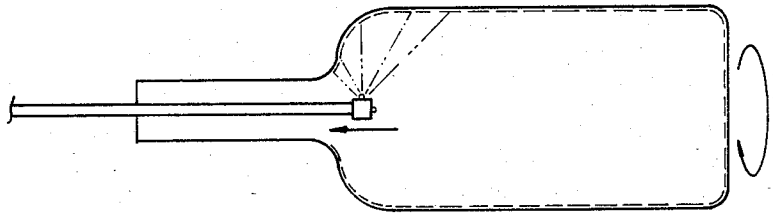
Figure 16:
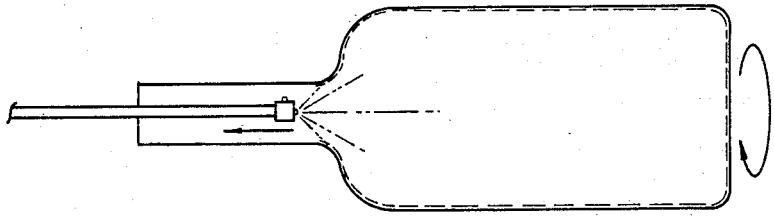
Figure 17:
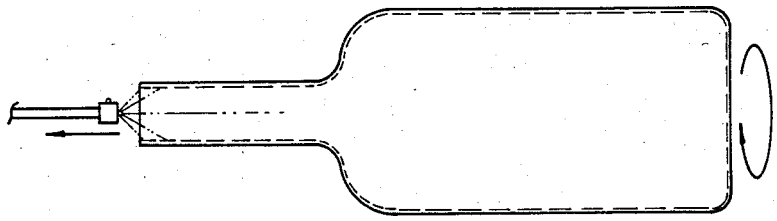

The second pump associated with the tip nozzle, reloads from the position illustrated in FIG. 10, to just before the position illustrated in FIG. 11. At approximately the nozzle position shown in FIG. 11, the second pump cam assembly is placed in a dwell mode. Between the position illustrated in FIG. 11 and the position illustrated in FIG. 12, the second pump is actuated to cause spraying from the nozzle tip through inward movement of its associated piston. The second pump causes the nozzle tip to stop spraying just prior to reaching the forward most portion of the cycle, as illustrated in FIG. 13 and FIG. 18. During rearward movement from the position of FIG. 13, to just before the position illustrated in FIG. 16, the second pump cam is in a dwell position. At the position illustrated in FIG. 16, the second pump cam causes the associated piston to be moved inwardly into the second pump body and thus, again, causes the nozzle tip to discharge and spray the neck area during movement from the position illustrated in FIG. 16 to the position illustrated in FIG. 17. The tip nozzle spray pattern may have an angle at the nozzle tip of between 20 degrees and 60 degrees and is preferably about 45 degrees. During spraying of the wall end and neck portion, a small amount of overlap is provided between the spray patterns of the tip nozzle and the side nozzle to ensure complete coverage of the bottle interior with spray coating. During the entire operating cycle, the nozzle means has a continuous air flow provided to it for atomizing and spray flattening, as described above, by compressed air flow from air compressor 25 through air supply line 36, 38 and into the associated air passages 66, 72 of the nozzle body 60.

It will be appreciated that the spray coating applied to the interior walls of the bottle in this manner is independent of the cycle speed, since spray coating is dispensed through positive movement of a piston into an associated pump body cavity and because the piston movement is entirely a function of nozzle tip position within the bottle 24. Thus, at least within reasonable operating limits, a precise and uniform spray coating may be provided to the interior surface 22 of a bottle 24, independent of such fluctuations as pressure in the coating supply source 41 or the rotational speed of the electric motor 140.

Although a particular embodiment of the invention has been described herein, it will be appreciated that relative motion between the nozzle tip and the bottle to be coated may be provided by means other than those specifically described herein. For example, rather than rotating the bottle, it might be possible to rotate the nozzle tip 60 during linear movement thereof in order to provide a similar spray pattern to that described above with varying degrees of success. Similarly, it would be possible to move the bottle 24 axially, i.e. in a longitudinal direction relative the nozzle 60, rather than moving the nozzle 60 with respect to the bottle, or any combination of the above described linear and rotational displacements might be used to produce a interior spray pattern similar to that described above. Lateral displacement between the nozzle means and different bottles might be provided by movement of the nozzle means, rather than the bottles. Positive actuation means might also be provided with respect to each of such alternate longitudinal and rotational displacement means to provide a precise and uniform spray coating.

Thus, it is contemplated that the inventive concepts herein described may be variously otherwise embodied and it is intended that the appended claims be construed to include alternative embodiments of the invention except insofar as limited by the prior art.

What is claimed is:

1. A high speed production apparatus for applying a uniform coating layer on the order of 0.001 inch thickness to the interior surface of a vessel having an interior cavity of variable diameter and a restricted opening extending into the interior cavity comprising:

a. coating material supply means for providing a supply of liquid coating material;

b. nozzle means operatively associated with said coating material supply means for spraying said liquid coating material onto the interior surface of the vessel;

c. coating material pumping means for pumping the coating material from said supply means through said nozzle means said pumping means comprising:

a pump body having an interior cavity for receiving liquid coating material therein and having an inlet orifice, an outlet orifice and a piston port in fluid communication with said interior cavity;

a pump piston means sealingly received within said piston port and linearly extendable and retractable into and out of said interior cavity;

first one-way valve means operatively associated with said inlet orifice for allowing flow of liquid coating material into said pump body from said supply means and for preventing flow from said pump body to said supply means; and second one-way valve means operatively associated with said outlet orifice for allowing flow of liquid coating material out of said pump body to said nozzle means and for preventing flow from said nozzle means to said pump body;

whereby extension of said pump piston means into said pump body cavity causes discharge of a volume of liquid coating material to said nozzle means which volume is substantially equal to the volume of the portion of said pump piston extended into said pump body;

whereby extraction of said pump piston from said pump body causes discharges of a volume of liquid coating material from said supply means into said pump body, which volume is substantially equal to the volume of the portion of said pump piston retracted from said pump body;

whereby substantially no compressible gas is introduced into said pump body during inflow of liquid coating material from said supply means;

whereby a hydraulic spring effect associated with the compression of trapped gas is prevented;

whereby the volume of coating material discharged from said pump body to said nozzle means is precisely regulated by the movement of said pump piston means;

d. elongate lance means having a central longitudinal axis for supporting said nozzle means thereon, said lance means and said nozzle means being of sufficiently small transverse dimension whereby said lance means and said nozzle means are insertable through the opening into the interior cavity of the vessel;

e. longitudinal displacement means for causing longitudinal displacement between the nozzle means and the vessel whereby the lance means and nozzle means are insertable into and removable from the opening of the vessel whereby said nozzle means is positionable into close proximity with selected portions of the vessel interior cavity;

f. coating spray control means for controlling the amount of coating material sprayed onto the interior surface of the vessel by said nozzle means;

g. said outlet orifice of said pump body being positioned at an upper most elevation of said pump body interior cavity whereby any gas present in said pump body cavity migrates to said outlet orifice for immediate discharge whereby any substantial gas buildup in said interior cavity is further prevented whereby said precise volume regulation of said discharge of coating material by movement of said pump piston means is maintained.

h. said coating spray control means being operatively associated with said longitudinal displacement means whereby the flow rate of coating material through said nozzle means is dependent upon the relative longitudinal displacement between said nozzle means and a vessel being coated;

said nozzle means comprising:

a first nozzle for spraying an end wall portion and a neck portion of a vessel; and a second nozzle for spraying a side wall portion and a shoulder portion of a vessel; said coating material pumping means comprising;

a first pump operatively associated with said second nozzle for spraying said vessel shoulder portion and side wall portion during relative inward movement of said nozzle into said vessel; and a second pump operatively associated with said first nozzle for use in spraying both said neck portion and said end wall portion of said vessel;

a third pump operatively associated with said second nozzle for spraying said vessel during relative outward movement of said nozzle from said vessel.

2. The invention of claim 1 wherein said first pump has a first cam assembly operatively associated therewith, said second pump has a second cam assembly operatively associated therewith, and said third pump has a third cam assembly operatively associated therewith; said cam assemblies being actuated by said longitudinal displacement between said nozzle means and a vessel being coated.

3. The invention of claim 2 wherein each of said cam assemblies comprise a generally longitudinally extending cam path, a cam follower operatively associated with said cam path and linkage means connecting said cam follower with said pump piston means of an associated pump for controllingly moving said pump piston means into and out of said interior cavity.

4. The invention of claim 3, wherein said cam path is fixed, with respect to linear movement, relative to a vessel to be coated and is movable, with respect to linear movement, relative to said nozzle means.

5. The invention of claim 4 wherein said linkage means between said cam follower and said piston means comprises a lever arm.

6. A method of applying a coating layer onto the interior surface of a bottle of the type having a central longitudinal axis and an interior cavity and an interior cavity opening positioned symmetrically relative the central longitudinal axis and having a bottom wall, a relatively large diameter lateral side wall, a shoulder wall and a relatively small diameter neck wall, comprising the steps of:

(a) positioning a small diameter nozzle body in coaxial relationship with the bottle central longitudinal axis longitudinally opposite the bottle opening;

(b) causing relative longitudinal reciprocal movement of the nozzle body along the bottle central longitudinal axis first from the position opposite the bottle opening to a forward position inside the bottle and proximate the bottle end wall and thence rearwardly to the original position opposite the bottle opening;

(c) during step (b) causing relative rotational movement of the bottle about its central longitudinal axis;

(d) during steps (b) and (c) spraying the interior of the bottle with a liquid coating material including:

(i) spraying the bottle shoulder wall with a nozzle side gun during forward movement of the nozzle body with respect to the bottle;

(ii) spraying the bottle side wall with said side gun during forward movement of the nozzle body with respect to the bottle;

(iii) spraying the bottle end wall with a nozzle tip gun during a latter portion of the forward movement of the nozzle body with respect to the bottle;

(iv) spraying the bottle side wall with said side gun during rearward movement of the nozzle body with repsect to the bottle;

(v) spraying the bottle shoulder wall with said side gun during rearward movement of the nozzle body with respect to the bottle; and (vi) spraying the bottle neck wall with said tip gun during rearward movement of the nozzle body with respect to the bottle;

(e) during step (d) precisely controlling the rate at which spray is distributed as a function of the axial position of the nozzle body with repsect to the bottle so as to provide an even thickness coating to the interior surface of the bottle.

7. A high speed production apparatus for applying a uniform coating layer on the order of 0.001 inch thickness to the interior surface of a vessel having an interior cavity of variable diameter and a restricted opening into the interior cavity comprising:

a. coating material supply means for providing a supply of liquid coating material;

b. nozzle means operatively associated with said coating material supply means for spraying said liquid coating material onto the interior surface of the vessel;

said nozzle means comprising:

a first nozzle for spraying an end wall portion and a neck portion of a vessel; and a second nozzle for spraying a side wall portion and a shoulder portion of a vessel;

c. coating material pumping means for pumping the coating material from said supply means through said nozzle means; said coating material pumping means comprising:

a first pump operatively associated with said second nozzle for spraying said vessel shoulder portion and side wall portion during relative inward movement of said nozzle into said vessel; and a second pump operatively associated with said first nozzle for use in spraying both said neck portion and said end wall portion of said vessel;

a third pump operatively associated with said second nozzle for spraying said vessel during relative outward movement of said nozzle from said vessel;

d. elongate lance means having a central longitudinal axis for supporting said nozzle means thereon, said lance means and said nozzle means being of sufficiently small transverse dimension whereby said lance means and said nozzle means are insertable through the opening into the interior cavity of the vessel;

e. longitudinal displacement means for causing longitudinal displacement between the nozzle means and the vessel whereby the lance means and nozzle means are insertable into and removable from the opening of the vessel whereby said nozzle means is positionable into close proximity with selected portions of the vessel interior cavity;

f. coating spray control means for controlling the amount of coating material sprayed onto the interior surface of the vessel by said nozzle means said coating spray control means being operatively associated with said longitudinal displacement means whereby the flow rate of coating material through said nozzle means is dependent upon the relative longitudinal displacement between said nozzle means and a vessel being coated.

8. The invention of claim 7 wherein said first pump has a first cam assembly operatively associated therewith, said second pump has a second cam assembly operatively associated therewith, and said third pump has a third cam assembly operatively associated therewith; said cam assemblies being actuated by said longitudinal displacement between said nozzle means and a vessel being coated.

9. The invention of claim 8 wherein each of said cam assemblies comprise a generally longitudinally extending cam path, a cam follower operatively associated with said cam path and linkage means connecting said cam follower with an associated one of said pumps.

10. The invention of claim 9 wherein said cam path is fixed, with respect to linear movement, relative to a vessel to be coated and is movable, with respect to linear movement, relative to said nozzle means.

* * * * *